US006196886B1

(12) United States Patent
Sato

(10) Patent No.: US 6,196,886 B1
(45) Date of Patent: Mar. 6, 2001

(54) CONTACT PIECES FOR USE IN AN ELECTRIC CONNECTOR AND METHOD OF MAKING THE SAME

(75) Inventor: Kiyoshi Sato, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/139,644

(22) Filed: Aug. 25, 1998

(30) Foreign Application Priority Data

Jul. 9, 1998 (JP) ..... 10-194397

(51) Int. Cl.[7] ..... H01R 9/24
(52) U.S. Cl. ..... 439/885; 439/907
(58) Field of Search ..... 439/876, 885, 439/874, 875, 78, 80, 81, 83, 189

(56) References Cited

U.S. PATENT DOCUMENTS 3,431,548 * 3/1969 Busler ..... 439/876
3,795,889 * 3/1974 Nauman et al. ..... 439/885
4,265,508 * 5/1981 Chrisholm ..... 439/885
4,384,754 * 5/1983 Douty et al. ..... 439/189
5,061,196 * 10/1991 Weston et al. ..... 439/189
5,112,255 * 5/1992 Daley, Jr. ..... 439/885
5,252,091 * 10/1993 Fujita et al. ..... 439/499
5,334,059 * 8/1994 Seidler ..... 439/876
5,547,405 * 8/1996 Pinney et al. ..... 439/894

* cited by examiner

*Primary Examiner*—Khiem Nguyen
*Assistant Examiner*—J. F. Duverne
(74) *Attorney, Agent, or Firm*—Arent Fox Kintner Plotkin & Kahn, PLLC

(57) ABSTRACT

A longitudinally elongated parallel-arrangement of contact pieces are each mounted in an insulating housing of an electric connector. The parallel arrangement of contact pieces (1) has a longitudinal carrier strip (3) integrally connected thereto. The contact pieces have transverse connections (4) preformed in the vicinity of their tails to connect adjacent contact pieces. Gangs of parallel-connected contact pieces can be easily made simply by cutting and removing selected transverse connections.

1 Claim, 4 Drawing Sheets

CONTACT PIECES FOR USE IN AN ELECTRIC CONNECTOR AND METHOD OF MAKING THE SAME

BACKGROUND OF THE INVENTION

1. Field of the Invention

The present invention relates to contact pieces to be mounted in the insulating housing of an electric connector and a method of making such contact pieces. Electric connectors are used in connecting PC cards to portable electronic apparatuses such as notebook-sized or mobile personal computers. Such an electric connector has some selected contact pieces parallel-connected to bear a relatively heavy electric current, which cannot be borne by a single contact piece. The present invention relates particularly to such contact pieces which are to be ganged in an electric connector, and are to be selectively parallel-connected to meet occasional demands.

2. Description of Related Art

In a group of such contact pieces, for example, female contact pieces for use in connecting a PC card to an associated electronic equipment some selected contact pieces in the group are parallel-connected to be allotted to an electric power supply because each single contact piece is too thin to bear a relatively heavy current flowing from the electric power supply. The number of the parallel-connected contact pieces thus allotted to the electric power supply is large enough to bear such a heavy electric current flowing from the electric power supply. Contact pieces as many as required for the purpose are selected in the group to be parallel-connected by winding an electric wire around the selected contact pieces and by soldering the so wound electric wire thereto. The wiring-and-soldering must be carried out by hand in a relatively small space, and is a tedious and time-consuming work. Accordingly the efficiency with which electric connectors can be made is lowered.

SUMMARY OF THE INVENTION

One object of the present invention is to provide contact pieces of the type which is described above, and is so designed that selected ones in a group of contact pieces can be easily parallel-connected to meet occasional demands.

To attain this object a longitudinally elongated parallel-arrangement of contact pieces having a carrier strip integrally connected to their tails is improved according to the present invention in that said contact pieces have transverse connections preformed in the vicinity of their tails to connect adjacent contact pieces.

The transverse connections may be preformed between the point at which the contact pieces are to be cut and separated from the carrier strip and the point at which the contact pieces are to appear from the contact slit, which is made in the insulating housing. The inter-contact connections can be selectively positioned within a relatively wide range, accordingly increasing the freedom of such contact designing.

Transverse connections can be selectively cut and removed to leave selected parallel-connected contact pieces to be allotted for example, to an electric power supply, thus eliminating any tedious and time-consuming works such as winding an electric wire around selected contact pieces and soldering the wound wire thereto. The parallel-connection of selected contact pieces thus formed is guaranteed free of any adverse effect which would be caused for instance, by incomplete soldering. Apparently the forming of parallel-connection of selected contact pieces is facilitated, and at the same time, a pleasing appearance is given to the parallel-connection of selected contact pieces.

Another object of the present invention is to provide a method of making contact pieces so as to facilitate selective parallel-connection.

To attain this object a method of producing contact pieces according to the present invention comprises the steps of: stamping a thin sheet of metal by dies to a longitudinally elongated parallel-arrangement of contact pieces having a longitudinal carrier strip integrally connected to their tails, said contact pieces having transverse connections preformed in the vicinity of their tails to connect adjacent contact pieces; cutting and removing selected transverse connections; and cutting and separating said longitudinal carrier strip to provide parallel-connections of selected contact pieces along with single contact pieces.

Other objects and advantages of the present invention will be understood from the following description of contact pieces according to the present invention.

DESCRIPTION OF THE PREFERRED EMBODIMENTS

Figure 1:
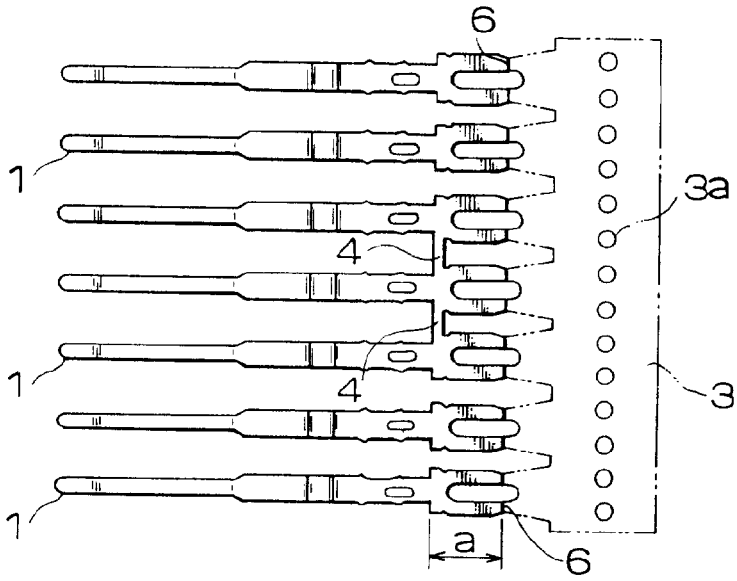
FIG. 1 shows a longitudinally elongated parallel-arrangement of contact pieces integrally connected to a longitudinal carrier strip, each contact piece having a relatively short tail length "a"

Referring to FIG. 1, a longitudinally elongated parallel arrangement of contact pieces 1 has a longitudinal carrier strip 3 integrally connected to the tails 6 of the contact pieces 1. These contact pieces 1 are separated from the carrier strip to be press-fitted in the contact slit of the insulating housing of an electric connector.

The longitudinally elongated parallel-arrangement of contact pieces 1 can be formed by stamping a thin sheet of metal 2 by dies. The longitudinal carrier strip 3 has a series of perforations 3*a* to be caught by transporting means.

As seen from the drawing, all contact pieces 1 have transverse connections 4 preformed to connect adjacent contact pieces 1.

Such transverse connections 4 may be preformed within a distance "a" from the point at which each contact piece 1 is to be cut and separated from the longitudinal carrier strip 3 to the point at which each contact piece 1 is to appear from the rear opening 5*c* of the contact slit 5*b*, which is made in the insulating housing 5*a*.

Figure 2:
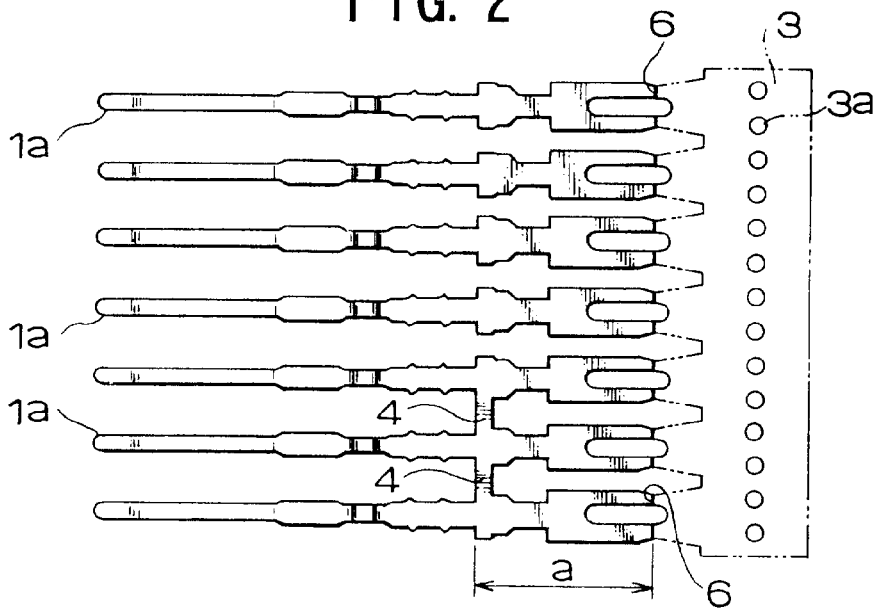
FIG. 2 shows another longitudinally elongated parallel-arrangement of contact pieces integrally connected to a longitudinal carrier strip, each contact piece having a relatively long tail length "a"

FIG. 2 shows another example of longitudinally elongated parallel arrangement of contact pieces 1, which is different from FIG. 1 only in that the transverse connections 4 are positioned more apart from the contact-and-carrier boundary than in FIG. 1.

Selected transverse connections 4 are cut and removed by punching dies while contact pieces 1 are being carried longitudinally with the perforations 3*a* of the longitudinal carrier strip 3 caught by transporting means.

Figure 3:
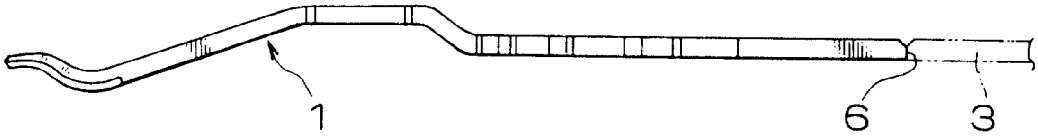
FIG. 3 is a side view of a contact piece.

Thereafter, each and every contact piece 1 is bent in dies to give it a required shape as shown in FIG. 3. After inserted contact piece assembly has been inserted in the insulating housing 5*a*, the carrier strip 3 is separated or removed from the contact piece assembly by cutting along the line 6—6 in FIG. 1.

So separated contact pieces are pushed in the contact slit 5*b* of the insulating housing 5*a* of an I/O female connector 5.

Figure 4:
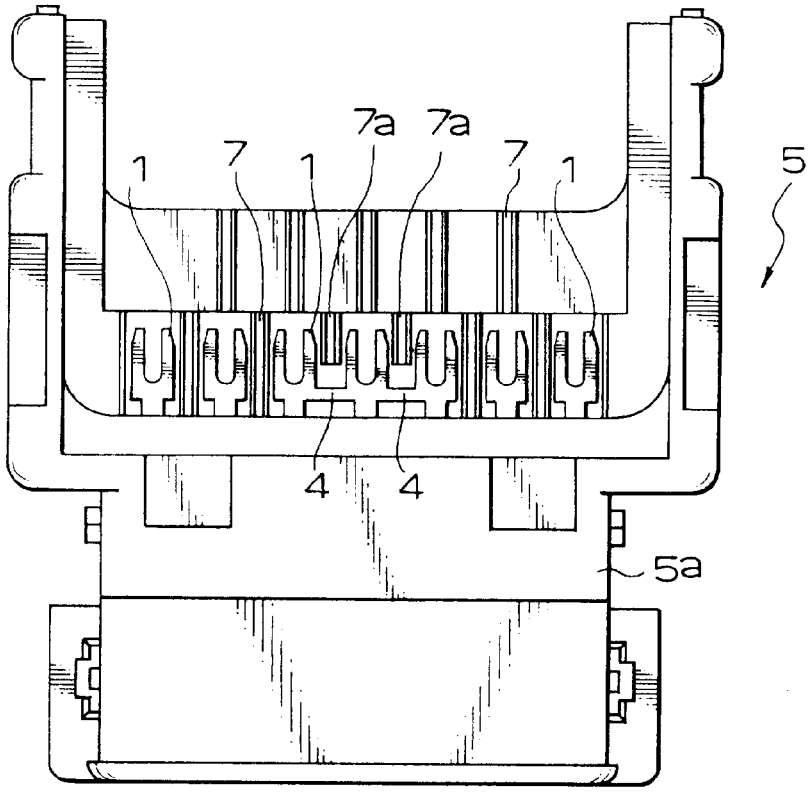
FIG. 4 is a plane view of an I/O female connector having two sets of contact pieces arranged on upper and lower shelves of the connector housing.
Figure 5:
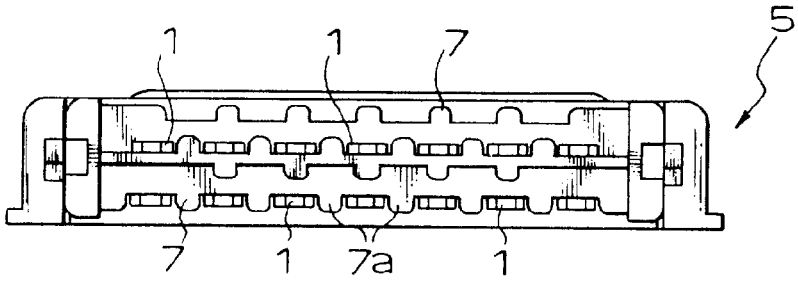
FIG. 5 is a rear view of the I/O female connector.
Figure 6:
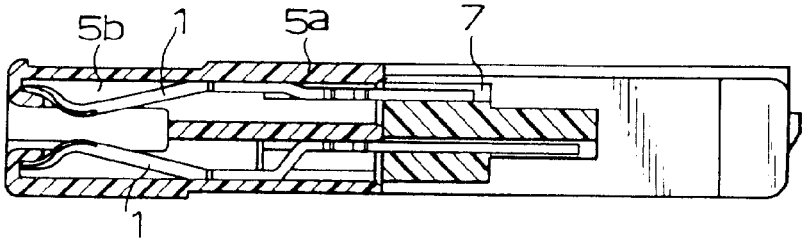
FIG. 6 is a longitudinal section of the I/O female connector.

Referring to FIGS.4 and 5, the I/O female connector 5 has seven contact pieces 1 each in upper and lower stages. As seen from FIG. 4, the three intermediate contact pieces 1 are parallel-connected by the intervenient transverse connections 4, thus permitting the so ganged contact pieces 1 to be allotted to an electric power supply.

Partition ridges 7 separate adjacent contact pieces 1. The intermediate partition ridges 7, however, are partly cut to avoid any interference with the transverse connections 4 of the intermediate contact pieces 1 thus parallel-connected.

Figure 7A:
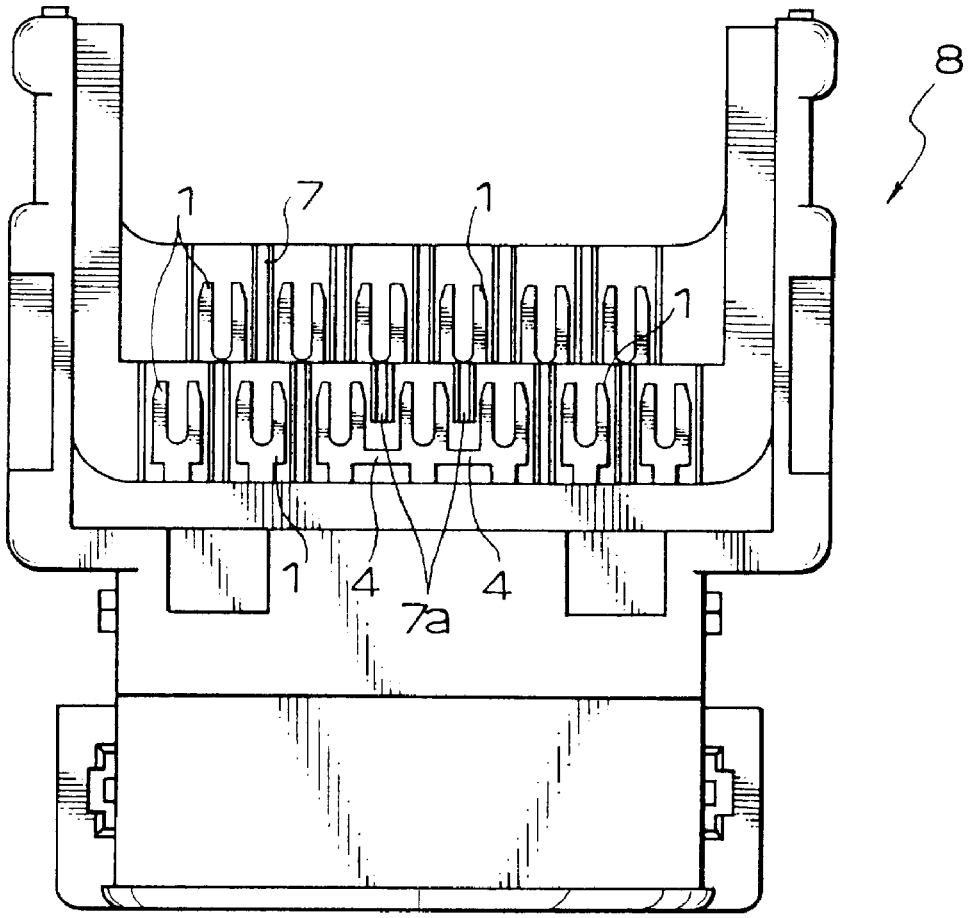
FIG. 7(*a*) is a plane view of another I/O female connector having four sets of contact pieces arranged on four shelves of the connector housing whereas FIG. 7(*b*) is a rear view of the I/O female connector.
Figure 7B:
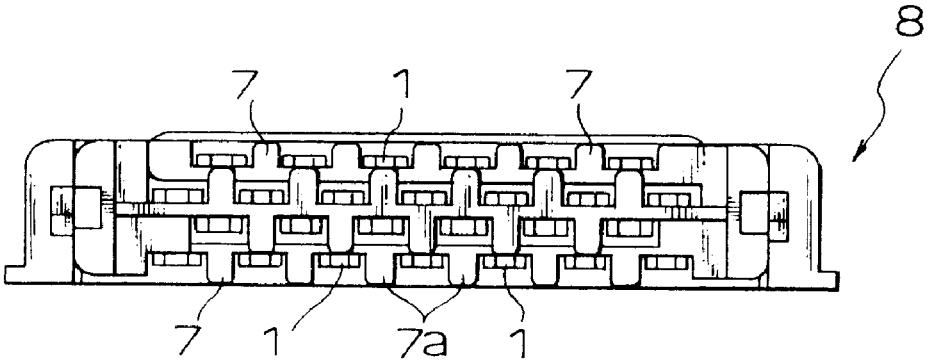

Referring to FIGS. 7(*a*) and 7(B), an I/O female connector 8 has six, seven, six and seven contact pieces arranged in the order named in four stages between its upper and lower sides.

Figure 8:
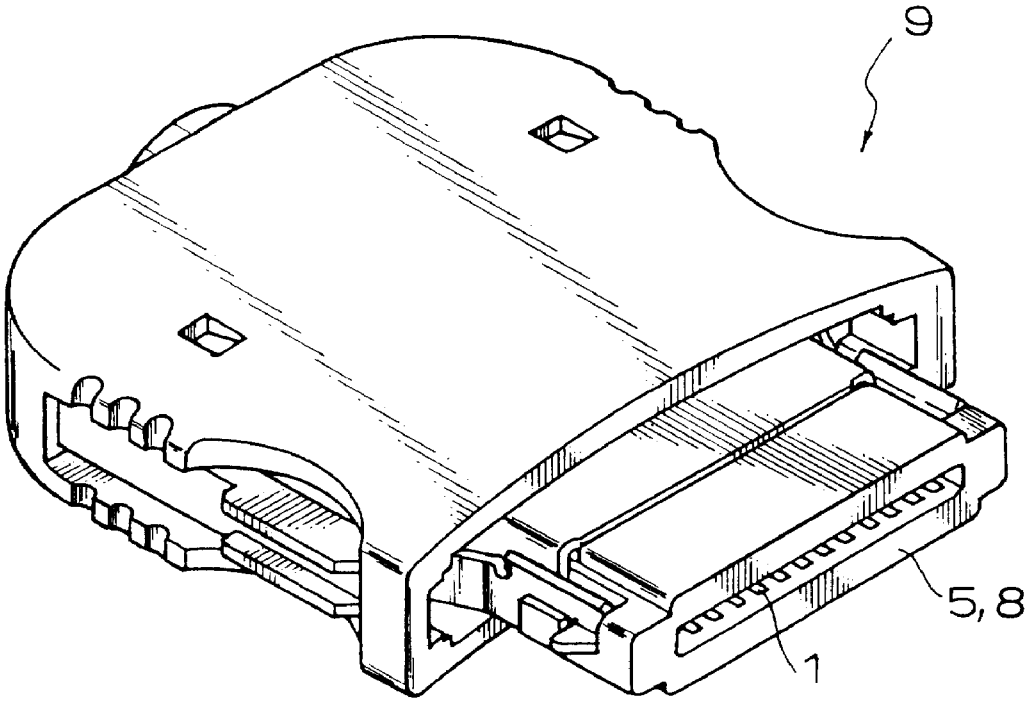
FIG. 8 is a perspective view of a cable connector equipped with contact pieces according to the present invention.
Figure 9:
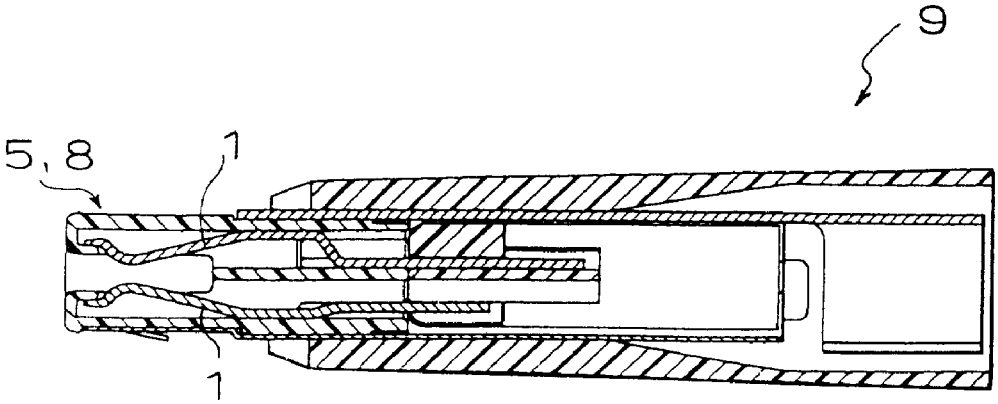
FIG. 9 is a longitudinal section of the cable connector.

Referring to FIGS. 8 and 9, an I/O female connector 5 or 8 is mounted in a cable connector housing 9.

As may be understood from the above, transverse connections are pre-formed between adjacent contact pieces in a longitudinal series of parallel-arranged contact pieces, and such transverse connections are selectively cut and removed to leave parallel-arrangements of contact pieces for carrying relatively heavy electric currents flowing for example, from an electric power supply. Pre-formation and selective removal of inter-contact connections facilitates the parallel-connecting of selected contact pieces to meet occasional demands. The following advantages are provided: reducing such tedious and time-consuming work as is experienced in soldering, accordingly improving the efficiency with which electric connectors can be made; stable and reliable inter-contact connections made, guaranteed free of adverse effects such as would be caused by incomplete soldering; pleasing appearance given to parallel-connections, which are thin and coplanar with adjacent contact pieces, and are free of any unpleasing projections; and significant contribution to the manufacturing of electric connectors of even quality.

What is claimed is:

1. A contact assembly comprising:

a carrier strip;

a longitudinally elongated parallel-arrangement of contact pieces connected to the carrier strip, each contact piece is mounted in an insulating housing of an electric connector, wherein some of said contact pieces are transversely and integrally connected in a vicinity of their tails to form a contact allotting to an electric power supply and each of the other contact pieces is individually arranged, wherein when the carrier strip is broken off the integrally connected contact remains electrically joined.

* * * * *